United States Patent [19]

Sakamoto et al.

[11] Patent Number: 4,506,278

[45] Date of Patent: Mar. 19, 1985

[54] THERMOSENSITIVE RECORDING MATERIAL

[75] Inventors: Hiroshi Sakamoto; Norihiko Inaba, both of Numazu; Keishi Taniguchi, Shizuoka, all of Japan

[73] Assignee: Ricoh Company, Ltd., Tokyo, Japan

[21] Appl. No.: 585,792

[22] Filed: Mar. 2, 1984

[30] Foreign Application Priority Data

Mar. 10, 1983 [JP] Japan ..... 58-39498

[51] Int. Cl.[3] ..... B41M 5/18

[52] U.S. Cl. ..... 346/216; 346/217; 346/225; 427/150; 427/151

[58] Field of Search ..... 106/14.5, 21; 346/216, 346/217, 225; 427/150, 151, 152, 153

[56] References Cited

U.S. PATENT DOCUMENTS

| | | | |
|---|---|---|---|
| 4,420,538 | 12/1983 | Nakamura et al. | 346/216 |
| 4,446,209 | 5/1984 | Iwakura et al. | 346/216 |
| 4,467,339 | 8/1984 | Asami et al. | 346/216 |

FOREIGN PATENT DOCUMENTS

| | | | |
|---|---|---|---|
| 8194 | 1/1982 | Japan | 346/216 |

*Primary Examiner*—Bruce H. Hess

*Attorney, Agent, or Firm*—Flynn, Thiel, Boutell & Tanis

[57] ABSTRACT

A thermosensitive recording material comprising a support material and a thermosensitive coloring layer formed on the support material, the thermosensitive coloring layer comprising a colorless or light-colored coloring material and a color developing material capable of coloring the coloring material upon application of heat thereto, is disclosed, in which the color developing material comprises at least one first bisphenol derivative of the formula (I) and at least one second bisphenol derivative of the formula (II), (I)

wherein n is an integer of 1 or 2, (II)

wherein X represents halogen, Y represents m is an integer of 1 or 2, and the substitution positions of Xm in the benzene rings are symmetrical with respect to Y.

6 Claims, No Drawings

THERMOSENSITIVE RECORDING MATERIAL

BACKGROUND OF THE INVENTION

The present invention relates to an improved thermosensitive recording material, and more particularly to a thermosensitive recording material comprising a support material and a thermosensitive coloring layer formed on the support material, which thermosensitive coloring layer comprises a colorless or light-colored coloring material and a developing material, which developing material contains at least two particular bisphenol derivatives, capable of coloring the coloring material upon application of heat thereto.

Recently, thermosensitive recording materials have been employed in a variety of fields, for instance, for use with printers of computers, recorders of medical analytical instruments, facsimile apparatus, automatic ticket vending apparatus, and thermosensitive copying apparatus, since they have the following advantages over other recording materials: (1) Images can be formed by simple heat application, without any complicated steps for development; (2) the thermosensitive recording materials can be produced by a simple apparatus and the storage of the thermosensitive recording materials is simple and does not involve excessive costs; (3) as the support material of the thermosensitive recording materials, paper is usually used, which is rather inexpensive in comparison with other support materials, such as synthetic resin films; and (4) when paper is used as the support material, the thermosensitive recording material has a pleasing plain-paper-like touch.

A conventional thermosensitive recording material is produced by coating a support material (for instance, a sheet of paper or a synthetic resin film) with a thermosensitive coloring liquid containing a coloring component and a color developing component which can be colored when heated, and then by drying the coloring liquid to form a thermosensitive coloring layer.

Images are formed and recorded in the thus produced thermosensitive recording material by heat application by use of a thermal pen or head.

Thermosensitive recording materials of the above-described type are disclosed, for instance, in Japanese Patent Publications No. 43-4160 and No. 45-14039.

The conventional thermosensitive recording materials have the shortcomings that they are slow in thermal response, not allowing rapid recording with high image density and high image sharpness.

In order to increase the thermal coloring sensitivity of these thermosensitive recording materials, there have been proposed methods in which a particular thermo-fusible material is added to the thermosensitive coloring layer, thereby attaining high thermal coloring sensitivity and allowing rapid recording with high image density and high image sharpness.

Examples of such thermo-fusible materials are disclosed, for instance, in the following Japanese laid-open patent applications: nitrogen-containing compounds, such as acetamide, stearamide, m-nitroaniline, and phthalic acid dinitrile in Japanese Laid-open Patent Application No. 49-38424; acetoacetanilide in Japanese Laid-Open Patent Application No. 52-106746; N,N-diphenylamine derivatives, benzamide derivatives and carbazole derivatives in Japanese Laid-open Patent Application No. 53-11036; alkylated biphenyls and biphenyl alkanes in Japanese Laid-Open Patent Application No. 53-39139. In Japanese Laid-Open Patent Application No. 56-144193, there are disclosed p-hydroxybenzoic acid ester derivatives which serve as thermo-fusible materials and as color developing materials.

Of the above compounds, p-hydroxy benzoic acid ester derivatives have been considered to be the best to be used as color developer in the thermosensitive coloring layer of the thermosensitive recording materials.

However, the method of using p-hydroxybenzoic acid derivatives still has the shortcomings that the recorded images fade and white powder or a crystal-like material appears on the surface of the image portions of the thermosensitive recording materials, so that the image portions are whitened.

SUMMARY OF THE INVENTION

It is therefore an object of the present invention to provide an improved thermosensitive recording material from which the above-described shortcomings of the conventional thermosensitive recording materials are eliminated, more specifically, which improved thermosensitive recording material is capable of allowing rapid recording with high image density and high thermal coloring sensitivity, without the recording image areas being faded and the formation of white powder or crystals on the image areas taking place.

According to the present invention, this object is attained by use of at least a first bisphenol derivative of the following formula (I) and a second bisphenol derivative of the following formula (II) in combination in a color developing material in a thermosensitive recording material of the type comprising a support material and a thermosensitive coloring layer formed on the support material, which thermosensitive coloring layer comprises a colorless or light-colored coloring material and a color developing material which colors the coloring material when heated to a predetermined temperature.

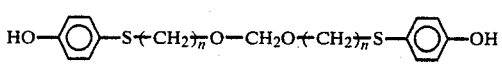

(I)

wherein n is an integer of 1 or 2.

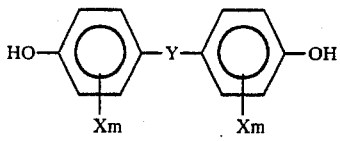

(II)

wherein X represents halogen, Y represents

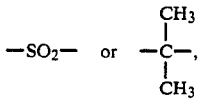

m is an integer of 1 or 2, and the substitution positions of Xm in the benzene rings are symmetrical with respect to Y.

DETAILED DESCRIPTION OF THE PREFERRED EMBODIMENTS

As mentioned above, a thermosensitive recording material according to the present invention comprises a support material and a thermosensitive coloring layer formed on the support material, which thermosensitive coloring layer comprises a colorless or light-colored coloring material and a color developing material capable of coloring the coloring material upon application of heat thereto, with a key feature thereof being that the color developing material comprises at least the first bisphenol derivative of the formula (I) and the second bisphenol derivative of the formula (II).

Specific examples of the first bisphenol derivatives of the formula (I) are as follows:

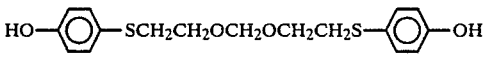

1,7-di(4-hydroxyphenylthio)-3,5-dioxaheptane

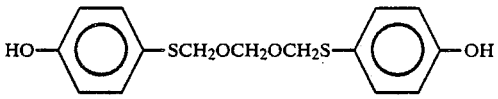

1,5-di(4-hydroxyphenylthio)-2,4-dioxapentane

Specific examples of the second bisphenol derivatives of the formula (II) are as follows:

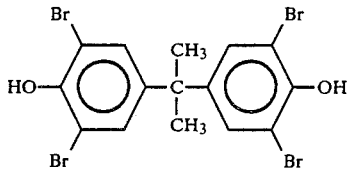

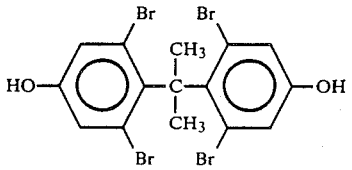

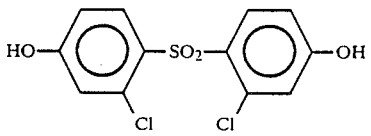

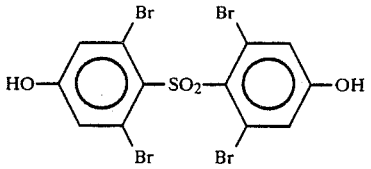

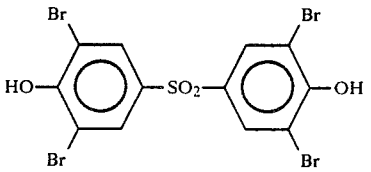

The first bisphenol derivatives of the formula (I) have melting points in the range of 100° C. to 150° C., have high coloring performance, and therefore exhibit higher thermal response than the conventional color developing materials, such as 4,4'-isopropylidenediphenol and 4,4'-butylidenediphenol, so that the first bisphenol derivatives are capable of yielding images with high and uniform image density.

The second bisphenol derivatives of the formula (II) have higher melting points than the first bisphenol derivatives of the formula (I). However, when the first and second bisphenol derivatives are used in combination, the two bisphenol derivatives constitute an eutectic mixture, so that recrystallization of the first bisphenol derivative in the developed image areas is prevented, and accordingly the fading and whitening of the developed image areas are prevented.

Generally, when two or more color developing materials are used in combination, it occurs that the water-solubility of the mixture of the color developing materials increases and the eutectic point thereof significantly decreases, resulting in that the fogging of the thermosensitive coating liquid and the background of the thermosensitive recording material considerably takes place during the storage thereof. The second bisphenol derivatives of the formula (II), however, do not have such problems, since the water-solubility thereof is low.

In the present invention, it is preferable that the developing material consisting essentially of a combination of the above described first bisphenol derivatives (at least one) and the second bisphenol derivatives (at least one) be employed in an amount of 1 to 10 parts by weight, more preferably in an amount of 2 to 6 parts by weight, with respect to 1 part by weight of the leuco dye.

Further, it is preferable that the ratio by weight of the first bisphenol derivative of the formula (I) to the second bisphenol derivative of the formula (II) employed in the present invention be in the range of (1:1) to (10:1), more preferably in the range of (2:1) to (5:1).

When necessary, conventional phenolic materials can be added to the above color developing material.

The thermosensitive recording material according to the present invention can be used in various structure including the conventional structures in which the thermal coloring reaction between the leuco dyes and the color developers are employed. For example, the thermosensitive recording material according to the present invention can be formed in the structure in which the leuco dye and the color developer are contained in the same coating layer on a support material. In another example, the thermosensitive coloring layer can be constructed so as to include at least 2 layers, and the leuco dye is contained in one layer and the color developer is contained in the other layer. In a further example, an intermediate layer is interposed between the leuco dye layer and the color developer layer, or a protective layer is formed on the front surface or back surface of the thermosensitive coloring layer.

The thermosensitive recording materials according to the present invention can also be used in the form of an image-transfer type recording material, which consists of, for instance, a transfer sheet with an image-transfer layer thereon containing the above-mentioned leuco dye, and an image receiving sheet with an image receiving layer thereon containing the above-mentioned color developer.

The thermal image transfer by use of the image-transfer type recording material is conducted, for instance, by closely superimposing the image receiving sheet on the image transfer layer, and performing direct thermal printing from the back side of the image transfer sheet by use of a thermal printer, whereby the desired colored images are formed on the image receiving layer of the image receiving sheet.

The leuco dyes for use in the present invention are those employed conventionally in the field of thermosensitive recording materials. They can be used alone or in combination. Examples of such leuco dyes for use in the present invention are triphenylmethane-type leuco compounds, fluoran-type leuco compounds, phenothiazine-type leuco compounds, auramine-type leuco compounds and spiropyran-type leuco compounds. Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-(N-benzyl-cyclohexylamino)-5,6-benzo-7-α-naphthylamino-4'-bromofluoran, and
3-diethylamino-6-methyl-7-methyl-7-mesidino-4',5'-benzofluoran.

As mentioned previously, these leuco dyes can be used alone or in combination.

In the present invention, a wide variety of conventional binder agents can be employed for binding and supporting the above-mentioned leuco dyes and color developing materials. Examples of the binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acryl-type copolymer.

Further in the present invention, auxiliary additive components which are employed in the conventional thermosensitive recording materials, such as fillers, surface active agents and thermo-fusible materials, can be employed.

As the fillers, for example, the following can be employed: inorganic powder such as powder of calcium carbonate, silica, zinc oxide, titanium oxide, aluminium hydroxide, zinc hydroxide, barium sulfate, clay, talc and surface-treated calcium carbonate and silica; and organic powder such as powder of urea-formaldehyde resin, styrene/metacrylic acid copolymer and polystyrene resin.

As the thermo-fusible materials, for example, the following can be employed: higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermo-fusible organic compounds with a melting point ranging from about 50° C. to 200° C.

The thermosensitive recording material according to the present invention can be prepared, for example, by applying a thermosensitive coloring layer formation liquid containing the above-mentioned components to an appropriate support material such as paper, synthetic paper or plastic film, followed by drying the applied thermosensitive coloring layer formation liquid. The thus prepared thermosensitive recording material according to the present invention can be employed for recording in a wide variety of fields.

In comparison with the conventional thermosensitive recording materials, the thermosensitive recording material according to the present invention is significantly improved with respect to the minimizing of the fading of recorded images and whitening thereof by the formation of white powder or crystals in the image areas, thermal sensitivity with high image density and the preservability of the recorded images, because of the use of the color developing material consisting essentially of the first and second bisphenol derivatives which are respectively represented by the previously described formula (I) and (II).

Referring to the following examples, embodiments of a thermosensitive recording material according to the present invention will now be explained in detail.

EXAMPLE 1

Liquid A and liquid B were prepared by grinding the respective following components in a ball mill for 1 day:

| | Parts by Weight |
|---|---|
| Liquid A | |
| 3-N—methyl-3-N—cyclohexylamino-6-methyl-7-anilinofluoran | 300 |
| 10% aqueous solution of polyvinyl alcohol | 300 |
| Water | 400 |
| Liquid B | |
| 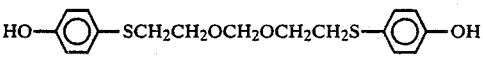 | 150 |
| 1,7-di(4-hydroxyphenylthio)-3,5-dioxaheptane) | |
| 2,2',6,6'-tetrabromo-4,4'-sulfonyl-diphenol | 50 |
| Calcium carbonate | 100 |
| 10% aqueous solution of polyvinyl alcohol | 200 |
| Water | 500 |

One part by weight of the liquid A and 8 parts by weight of the liquid B were mixed, so that a thermosensitive coloring layer formation liquid was prepared. The thermosensitive coloring layer formation liquid was applied with a deposition of 5 g/m$^2$ by a wire bar to a sheet of high quality paper with a base weight of 52 g/m$^2$, and was then dried, whereby a thermosensitive coloring layer was formed. The thus prepared thermosensitive recording material was subjected to calendering, so that the smoothness of the surface of the thermosensitive coloring layer was caused to be in the range of 700 to 1200 in terms of Bekk's smoothness, whereby a thermosensitive recording material No. 1 according to the present invention was prepared.

EXAMPLE 2

Example 1 was repeated except that the 2,2',6,6'-tetrabromo-4,4'-sulfonyldiphenol in the liquid B was replaced by 2,2-bis(3,5-dibromo-4-hydroxyphenyl)propane, whereby a thermosensitive recording material No. 2 according to the present invention was prepared.

EXAMPLE 3

Example 1 was repeated except that the 1,7-di(4-hydroxyphenylthio)-3,5-dioxaheptane in the liquid B was replaced by 1,5-di(4-hydroxyphenylthio)-2,4-dioxapentane, whereby a thermosensitive recording material No. 3 according to the present invention was prepared.

COMPARATIVE EXAMPLE 1

Example 1 was repeated except that 2,2',6,6'-tetrabromo-4,4'-sulfonyldiphenol in the liquid B was replaced by the same amount of 1,7-di(4-hydroxyphenylthio)-3,5-dioxaheptane, whereby a comparative thermosensitive recording material No. 1 was prepared.

COMPARATIVE EXAMPLE 2

Example 1 was repeated except that the 1,7-di(4-hydroxyphenylthio)-3,5-dioxaheptane in the liquid B was replaced by the same amount of 2,2',6,6'-tetrabromo-4,4'-sulfonyldiphenol, whereby a comparative thermosensitive recording material No. 2 was prepared.

COMPARATIVE EXAMPLE 3

Example 1 was repeated except that 1,7-di(4-hydroxyphenylthio)-3,5-dioxaheptane in the liquid B was replaced by the same amount of p-hydroxy benzylbenzoate, and 2,2',6,6'-tetra-bromo-4,4'-sulfonyldiphenol in the liquid B was also replaced by the same amount of 2,2'-methylenebis(3-methyl-6-t-butylphenol), whereby a comparative thermosensitive recording material No. 3 was prepared.

The thermosensitive recording materials No. 1 through No. 3 according to the present invention and the comparative thermosensitive recording materials No. 1 through No. 3 were subjected to dynamic thermal coloring sensitivity tests, image fading tests, and visual inspection of the formation of white powder or crystals in the recorded image areas.

The dynamic thermal coloring sensitivity tests were conducted by performing thermal printing on each of the above thermosensitive recording materials by a thermal printing experiment apparatus having a thin-film thermal head (commercially available by Matsushita Electronic Components Co., Ltd.), with application of electric power of 0.45 W/dot to the thermal head for a recording time of 20 ms per line, and with a scanning line density of 8×3.85 dots/mm, with the pulse width thereof being changed to 1.0, 1.2, 1.4, 1.6, 1.8 and 2.0 msec. The density of each of the printed images was measured by use of a Macbeth densitometer RD-514 with a filter W-106 attached thereto.

The image fading tests were conducted to the thermosensitive recording material samples with printed images having an image density ranging from 1.0 to 1.2, which were obtained in the above dynamic thermal coloring sensitivity tests, by allowing the samples to stand at room temperature for 15 days.

The image fading degree was determined in accordance with the following formula:

$$\text{Image Density Decreasing Ratio} = \frac{D_0 - D}{D_0} \times 100\%$$

where $D_0$ is the initial density of a printed image and D is the image density after 15 days in the above tests.

The visual inspection of the formation of white powder or crystals in the recorded image areas was performed by allowing each sample obtained in the dynamic thermal coloring sensitivity tests to stand at room temperature for 15 days as in the image fading tests. The formation of white powder or crystals in the recorded image areas was visually inspected. The results of the above-mentioned tests are summarized in the following table.

TABLE 1

| | Dynamic Thermal Coloring Sensitivity | | | | | | Image Fading Ratio | Whitening of Recorded Images |
|---|---|---|---|---|---|---|---|---|
| | 1.0 ms | 1.2 ms | 1.4 ms | 1.6 ms | 1.8 ms | 2.0 ms | | |
| Example 1 | 0.55 | 0.81 | 1.06 | 1.18 | 1.24 | 1.26 | 6% | o |
| Example 2 | 0.52 | 0.82 | 1.07 | 1.17 | 1.24 | 1.27 | 8% | o |
| Example 3 | 0.54 | 0.82 | 1.08 | 1.19 | 1.25 | 1.27 | 7% | o |
| Comparative Example 1 | 0.53 | 0.83 | 1.08 | 1.20 | 1.25 | 1.28 | 33% | o |
| Comparative Example 2 | 0.08 | 0.08 | 0.08 | 0.12 | 0.20 | 0.32 | 12% | o |
| Comparative Example 3 | 0.48 | 0.75 | 1.02 | 1.14 | 1.23 | 1.26 | 15% | Δ |

Note:
o: Almost no white powder or crystals were formed in the recorded image areas.
Δ: White powder or crystals were slightly formed in the recorded image areas, but there was no problem for practical use.

As can be seen from the results shown in the above table, the thermosensitive recording materials according to the present invention are improved with respect to the dynamic thermal coloring sensitivity, the image fading degree and the whitening of the recorded images, in comparison with the comparative thermosensitive recording materials.

What is claimed is:

1. In a thermosensitive recording material comprising a support material and a thermosensitive coloring layer formed on said support material, said thermosensitive coloring layer comprising a colorless or light-colored coloring material and a color developing material capable of coloring said coloring material upon application of heat thereto, the improvement wherein said color developing material comprises at least one first bisphenol derivative of the formula (I) and at least one second bisphenol derivative of the formula (II),

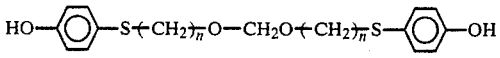

(I)

wherein n is an integer of 1 or 2,

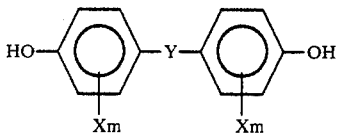

(II)

wherein X represents halogen, Y represents

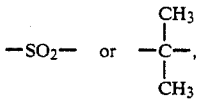

m is an integer of 1 or 2, and the substitution positions of Xm in the benzene rings are symmetrical with respect to Y.

2. A thermosensitive recording material as claimed in claim 1, wherein the amount of said color developing material is in the range of 1 to 10 parts by weight with respect to 1 part by weight of said leuco dye.

3. A thermosensitive recording material as claimed in claim 1, wherein the ratio of said first bisphenol derivative of the formula (I) to said second bisphenol derivative of the formula (II) is in the range of (1:1) to (10:1) in terms of parts by weight.

4. A thermosensitive recording material as claimed in claim 1, wherein said leuco dye is selected from the group consisting of triphenylmethane-type leuco compounds, fluoran-type leuco compounds, phenothiazine-type leuco compounds, auramine-type leuco compounds and spiropyran-type leuco compounds.

5. A thermosensitive recording material as claimed in claim 1, wherein said first bisphenol derivative of the formula (I) is selected from the group consisting of 1,7-di(4-hydroxyphenylthio)-3,5-dioxaheptane and 1,5-di(4-hydroxyphenylthio)-2,4-dioxapentane.

6. A thermosensitive recording material as claimed in claim 1, wherein said second bisphenol derivative of the formula (II) is selected from the group consisting of

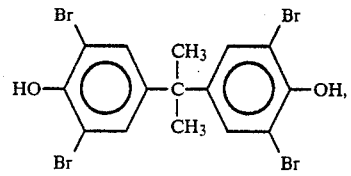

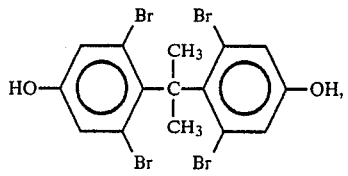

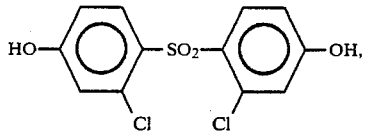

-continued
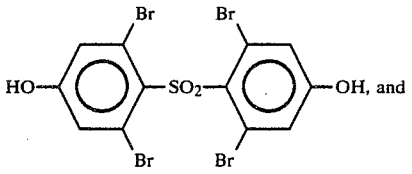
-continued
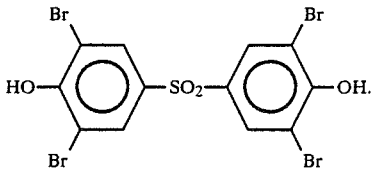
* * * * *